United States Patent [19]

Morgan

[11] Patent Number: 4,493,609

[45] Date of Patent: Jan. 15, 1985

[54] PUMPING APPARATUS

[75] Inventor: George J. Morgan, Ossining, N.Y.

[73] Assignee: Stauffer Chemical Company, Westport, Conn.

[21] Appl. No.: 470,364

[22] Filed: Feb. 28, 1983

[51] Int. Cl.[3] ..... F04D 15/02

[52] U.S. Cl. ..... 415/20; 415/176; 415/149 R; 415/17

[58] Field of Search ..... 415/175, 176, 20, 17, 415/149 R, 108, 170 R, 170 A; 417/366, 368

[56] References Cited

U.S. PATENT DOCUMENTS

| | | | |
|---|---|---|---|
| 1,891,201 | 12/1932 | Hoff | 415/175 X |
| 2,281,682 | 5/1942 | England | 415/175 |
| 2,764,943 | 10/1956 | Peters | 417/372 |
| 2,928,249 | 3/1960 | Miles | 415/108 X |
| 3,048,118 | 8/1962 | Erd | 415/175 X |
| 3,130,878 | 4/1964 | Zimmermann | 415/108 X |
| 3,333,545 | 8/1967 | Covalt et al. | 415/175 |
| 3,339,491 | 9/1967 | Malloch et al. | 415/175 |
| 3,481,274 | 12/1969 | Napolitano | 415/11 X |

FOREIGN PATENT DOCUMENTS

| | | | |
|---|---|---|---|
| 1138519 | 6/1957 | France | 415/175 |
| 279448 | 3/1928 | United Kingdom | 415/175 |
| 788831 | 1/1958 | United Kingdom | 415/175 |

*Primary Examiner*—Everette A. Powell, Jr.
*Attorney, Agent, or Firm*—Hensley M. Flash

[57] ABSTRACT

An apparatus for pumping a liquid stored under pressure without pressure-induced, liquid leakage during seal failure. The liquid or slurry being pumped is usually of a type that is difficult to handle, e.g., liquids which are volatile, poisonous, corrosive or a combination of these characteristics.

The apparatus comprises in combination a vessel capable of containing a liquid under pressure; a vertical pump with its inlet port in communication with the vessel; an equalizing line connecting the shaft housing of the pump with the vapor space of the vessel; and a shaft seal located within the pump above the equalizing line connection so that the vessel and the shaft housing can be pressure-equalized during seal failure.

The apparatus further provides pressure sensitive switching means so that the pump can be isolated upon occurrence of a specified pressure change within the vessel.

5 Claims, 2 Drawing Figures

PUMPING APPARATUS

FIELD OF THE INVENTION

This invention relates generally to an apparatus for pumping a liquid stored under pressure. More particularly the present invention relates to an improved pumping apparatus for transmitting fluids, such as liquids or slurries which are difficult to handle, e.g., fluids which are volatile, poisonous, corrosive or a combination of these characteristics or fluids which possess other characteristics which make it important that leakage of the fluid during transmission be kept to a minimum, and preferably be eliminated entirely.

BACKGROUND OF THE INVENTION

There are known systems for transmitting fluids in a manner that minimize fluid loss during transmission. For example, mechanical shaft seals have been employed around the rotating shaft of a pump to seal the interior of a pump from the exterior. However, pumping dangerous liquids where seals are employed usually presents both a safety and a maintenance concern because of the propensity for these mechanical seals to break down resulting in material, often toxic to humans, being lost from the system. Pumping slurry-containing liquids enhances these concerns because the abrasive qualities of these slurry-containing liquids usually aggravate the propensity for seal breakdown.

Another system for transmitting fluids while minimizing fluid loss is by the use of canned motor pumps. Canned motor pumps are constructed such that the pump and the motor are formed integrally. The impeller of the pump and the rotor of the electric motor for operating the pump actually rotates while the entire motor and pump assembly is immersed within the fluid to be transmitted. Canned motor pumps have no packing glands, and a seal is provided to the pumped fluid solely by means of gaskets. Canned motor pumps, because of their location within the vessel containing the fluid to be transmitted, can be made essentially leakproof. Since the rotary bearing portion of these canned motor pumps is usually lubricated by the transmitted fluid itself, the handling of liquids of the type described above, especially slurry-containing liquids, will cause abnormal wear of the bearing and shaft which will inevitably require the cessation of operation of the pump.

Magnet driven pumps have been suggested for transmitting these special fluids but their reliability is low. These special pumping problems are further aggravated and compounded when the fluids to be transmitted are under pressure. Fluid will usually be ejected under pressure from holes that develop in the system.

Vertical pumps, i.e. pumps whose shaft are maintained in a vertical position, are normally installed external to a storage vessel to be evacuated and have been used to pump special fluids when they are not being stored under pressure. However, there is no known external pumping system for safely and effectively pumping a slurry-containing liquid or a dangerous liquid both of which are under pressure. High pressure pumps for handling even ordinarily harmless liquids have been found to be prone to leakage, especially at their seal location.

Although various attempts have been made to overcome the problem inherent in pumping slurry-containing liquids and dangerous chemicals, all being under pressure, no completely satisfactory solution has been found prior to the present invention.

The present invention overcomes the problems of the prior art and provides an apparatus which employs a vertical pump in a manner which is safer and more effective than heretofore known. The present apparatus provides means for substantially or completely eliminating fluid loss through seal leakage in a vertical pump while pumping slurry-containing liquids and dangerous chemicals all being under pressure. The present apparatus further permits the vertical pump to be automatically isolated when seal leakage occurs so that the spills that usually accompany these leaks can be reduced or completely eliminated.

SUMMARY OF THE INVENTION

In accordance with the present invention there is provided apparatus for pumping a liquid stored under pressure without pressure-induced, liquid leakage during seal failure comprising in combination: a vessel capable of containing a liquid under pressure; a vertical pump having an inlet port in communication with the vessel; a shaft housing of the pump and a conduit connected to the shaft housing, said conduit being connected to the vessel at the other end with both ends of the conduit being located above the level of the liquid to be contained within the vessel; and a shaft seal on the shaft conveying rotary power to the impeller of the pump located within the pump above the point where the conduit is connected to the shaft housing and above the liquid level so that the vessel and the shaft housing is pressure equalized during seal failure.

The apparatus further provides pressure sensitive switching means so that the pump can be isolated from the vessel upon occurrence of a specified pressure change within the vessel.

DETAILED DESCRIPTION OF THE INVENTION

Figure 1:
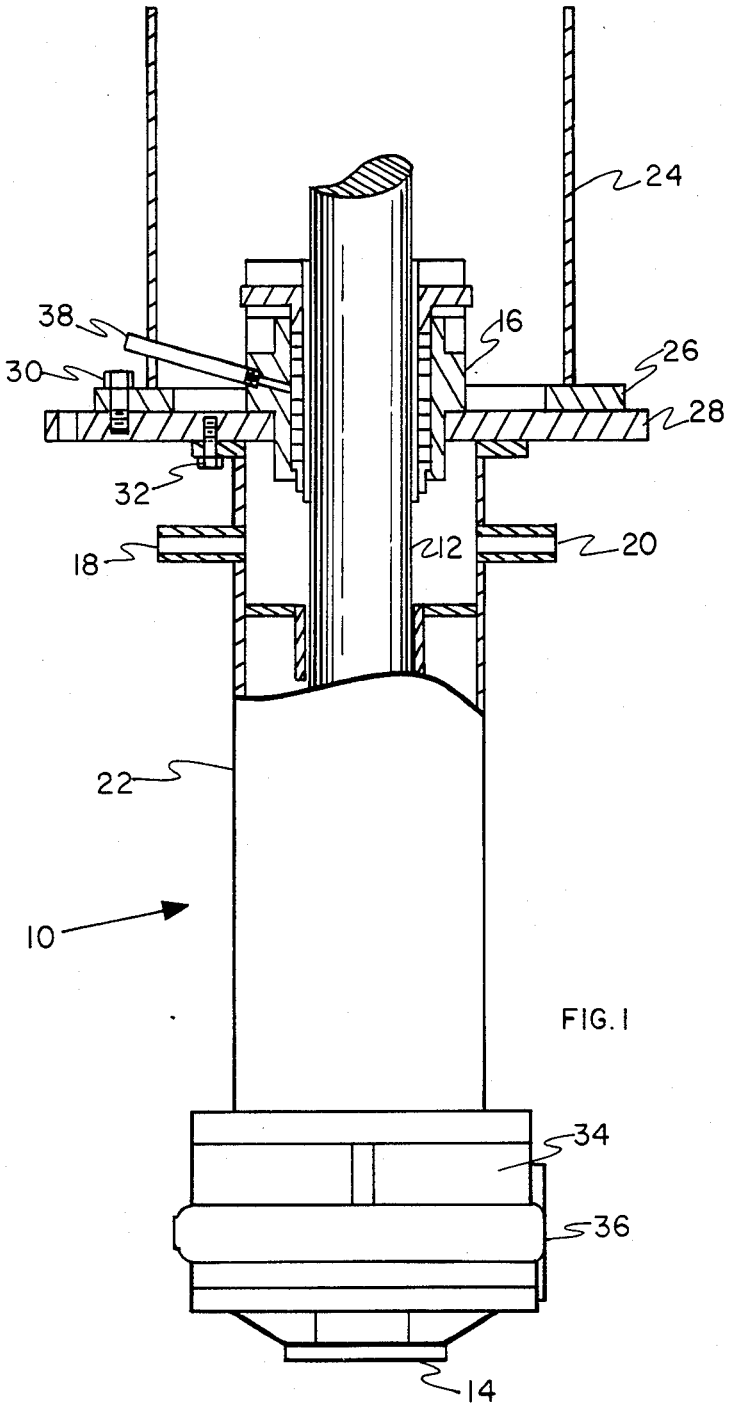
FIG. 1 is a sectional view, partially cut-away, of a pump which may be employed in accordance with this invention.

FIG. 1 illustrates a vertical pump 10 which can be mounted outside a liquid-containing vessel capable of containing a liquid under pressure and employed in accordance with this invention. Pump 10 is maintained with shaft 12 in a vertical position. Inlet port 14 is located near the lower end of pump 10 and shaft seal 16 is located near the upper end of shaft 12. Equalization port 18 and padding port 20 provide access to the interior of shaft housing 22 of pump 10. Padding port 20 is optional. Both ports 18 and 20 are located below seal 16 but above inlet port 14.

Motor mounting 24 supports a motor (not shown) that is connected to the upper end of shaft 12. The lower end of motor mounting 24 terminates in flange 26, which is connected to one side of cover plate 28 by bolt 30. Cover plate 28 is connected on the other side by bolt 32 to shaft housing 22 which is partially cut-away. Impeller casing 34 covering impeller (not shown) and having outlet port 36 on one side is located at the end of shaft 12. Motive power means is usually attached to shaft 12 above shaft seal 16 to rotate the impeller.

Shaft seal 16 surrounds shaft 12 at the intersection of motor mounting 24 and shaft housing 22. Seal 16 can be of the conventional mechanical type shaft seals, or liquid seals or can include packing glands. Seal purge inlet 38 is provided for sealing shaft seal 16 with inert gas or liquid.

Figure 2:
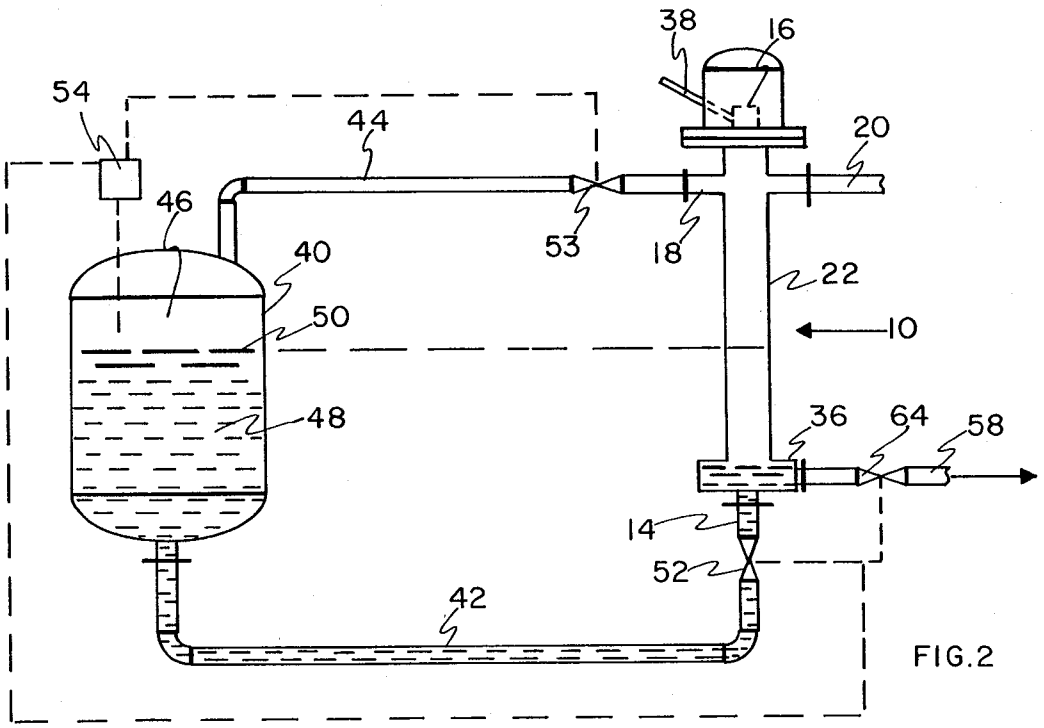
FIG. 2 is a schematic diagram of a pump system representing one embodiment of the present invention.

FIG. 2 illustrates an embodiment of a pumping apparatus which can be employed in accordance with this invention. In FIG. 2, vertical pump 10 is mounted outside storage vessel 40 with inlet port 14 of pump 10 in communication with vessel 40 via conduit 42. Shaft housing 22 of pump 10 is connected by way of equalization port 18 to one end of conduit 44. The other end of conduit 44 is connected to the top of storage vessel 40 providing access to vapor space 46 located above liquid 48 stored within vessel 40. Shaft seal 16 is located within pump 10 above equalization port 18. Pump 10 is positioned so that equalization port 18 is located above liquid level 50 in storage vessel 40.

Pump inlet port 14, equalization port 18 and pump outlet port 36 are fitted with conduits 42, 44 and 58 and valves 52, 53 and 64 respectively to allow pump 10 to be sealed off. Pressure switch 54 is wired into isolating valves 52, 53 and 64 to close automatically, thereby isolating pump 10 from vessel 40, upon occurrence of a specified pressure change within vessel 40.

In mounting vertical pump 10 outside of storage vessel 40, pump 10 can be supported from a stand, a steel frame, a wall or even storage vessel 40 itself as long as seal 16 and equalization port 18 are kept above the liquid level within storage vessel 40. This arrangement allows conduit 44 to maintain vapor space 46 and the interior of shaft housing 22 at the same pressure. In case of a leakage at seal 16, liquid 48 will flow up to liquid level 50, at most, because the pressure being exerted in vapor space 46 and shaft housing 22 will be equalized by conduit 44. Conduit 44 equalizes the pressure at both locations, thus the liquid level is maintained below the level of equalization port 18 and usually at liquid level 50 where the pressures within the apparatus are balanced. Liquid 48 cannot surge up through seal 16 because the pressure-equalizing conduit 44 is located below seal 16. Vapor may be released but neither liquid nor slurry will be released if seal 16 breaks down.

Isolating valves 52,53 and 64 can be automatically actuated by pressure switch 54 when seal 16 breaks down. This effectively isolates pump 10 and secures liquid 48 within storage tank 40 except for residual liquid contained within pump 10 above valve 52. This residual liquid can be maintained below or at liquid level 50. Pressure switch 54 is calibrated to actuate isolating valves 52, 53 and 64 upon occurrence of a specified pressure change within vapor space 46. The particular actuation pressure change will depend upon the particular operating pressure of the system. One skilled in the art can easily select such an actuation pressure differential to accommodate the particular pressure system with due regard to good manufacturing practices. Closing valve 64 prevents backflow of the liquid being pumped when pump 10 is inoperative.

Pump 10 can be inert gas padded through padding port 20. Purging of pump 10 and related conduits and connections with a dry inert gas can be accomplished in the usual manner.

Inasmuch as the present invention is subject to many variations, modifications and detail changes, a number of which have been expressly stated herein, it is intended that all matter described within this entire specification or depicted in the accompanying drawings be interpreted as merely illustrative and not limiting.

What is claimed is:

1. An apparatus for pumping a liquid stored under pressure without pressure-induced, liquid leakage during seal failure comprising in combination:

(a) a vessel capable of containing a liquid under pressure;

(b) a vertical pump having an inlet port in communication with the vessel;

(c) a shaft housing of the pump and a conduit connected to the shaft housing, said conduit being connected to the vessel at the other end with both ends of the conduit being located above the level of the liquid to be contained within the vessel; and (d) a shaft seal on the shaft conveying rotary power to the impeller of the pump located within the pump above the point where the conduit is connected to the shaft housing and above the liquid level so that the vessel and the shaft housing is pressure-equalized during seal failure.

2. The apparatus of claim 1 further comprising means for isolating said pump.

3. The apparatus of claim 2 further comprising pressure sensitive switching means capable of actuating said isolating means so that the pump can be isolated upon occurrence of a specified pressure change within the vessel.

4. The apparatus of claim 2 wherein the means for isolating said pump are valves.

5. The apparatus of claim 3 wherein the means for isolating said pump are valves.

* * * * *